US010876406B2

(12) United States Patent
Spadacini et al.

(10) Patent No.: US 10,876,406 B2
(45) Date of Patent: Dec. 29, 2020

(54) RADIAL TURBOMACHINE

(71) Applicant: EXERGY S.P.A., Bologna (IT)

(72) Inventors: Claudio Spadacini, Verbania Suna (IT); Dario Rizzi, Bisuschio (IT)

(73) Assignee: EXERGY S.P.A., Bologna (IT)

( * ) Notice: Subject to any disclaimer, the term of this patent is extended or adjusted under 35 U.S.C. 154(b) by 976 days.

(21) Appl. No.: 15/127,975

(22) PCT Filed: Mar. 17, 2015

(86) PCT No.: PCT/IB2015/051946
§ 371 (c)(1),
(2) Date: Sep. 21, 2016

(87) PCT Pub. No.: WO2015/140711
PCT Pub. Date: Sep. 24, 2015

(65) Prior Publication Data

US 2017/0107819 A1 Apr. 20, 2017

(30) Foreign Application Priority Data

Mar. 21, 2014 (IT) ..... MI2014A0488

(51) Int. Cl.
*F01D 5/04* (2006.01)
*F01D 11/00* (2006.01)
(Continued)

(52) U.S. Cl.
CPC ..... *F01D 5/041* (2013.01); *F01D 5/12* (2013.01); *F01D 9/026* (2013.01); *F01D 9/041* (2013.01);
(Continued)

(58) Field of Classification Search
CPC ..... F01D 1/06; F01D 1/14; F01D 1/22; F01D 1/28; F01D 11/001; F01D 25/24;
(Continued)

(56) References Cited

U.S. PATENT DOCUMENTS 1,468,694 A * 9/1923 Bonom ..... F01D 5/041 416/215
2,020,793 A * 11/1935 Meininghaus ..... F01D 5/041 415/84
(Continued)

FOREIGN PATENT DOCUMENTS

FR 428778 A 9/1911
GB 24137 A 3/1911
(Continued)

OTHER PUBLICATIONS

Jun. 12, 2016 Search Report issued in International Patent Application No. PCT/IB2015/051946.
(Continued)

*Primary Examiner* — Kenneth J Hansen
*Assistant Examiner* — Julian B Getachew
(74) *Attorney, Agent, or Firm* — Oliff PLC

(57) ABSTRACT

Radial turbomachine includes fixed case; one rotor disc installed in case and having rotor blades mounted on front face thereof; plurality of elements projecting from case and terminating proximity to rotor disc, wherein projecting elements include seal elements acting against rotor disc are operatively active on rear face of rotor disc or stator blades radially interposed between rotor blades of rotor disc; and one support plate bearing projecting elements and installed in case. Support plate is radially extended across from rotor disc and includes plurality of first circular portions concentric with rotation axis of rotor disc and plurality of second circular portions radially interposed between first circular portions. Several of first circular portions bear projecting elements and second circular portions are more deformable, along radial directions, than first circular portions in manner to allow relative movements between first circular portions
(Continued)

when support plate is subjected to action of thermal gradients.

22 Claims, 5 Drawing Sheets

(51) Int. Cl.

| | |
|---|---|
| ***F01D 21/00*** | (2006.01) |
| ***F01D 25/24*** | (2006.01) |
| ***F01D 5/12*** | (2006.01) |
| ***F01D 9/04*** | (2006.01) |
| ***F04D 27/00*** | (2006.01) |
| ***F04D 29/08*** | (2006.01) |
| ***F04D 29/28*** | (2006.01) |
| ***F04D 29/42*** | (2006.01) |
| ***F04D 29/44*** | (2006.01) |
| ***F01D 9/02*** | (2006.01) |

(52) U.S. Cl.
CPC ..... *F01D 11/001* (2013.01); *F01D 21/003* (2013.01); *F01D 25/24* (2013.01); *F04D 27/001* (2013.01); *F04D 29/083* (2013.01); *F04D 29/284* (2013.01); *F04D 29/4206* (2013.01); *F04D 29/444* (2013.01); *F05D 2260/83* (2013.01)

(58) Field of Classification Search
CPC ..... F01D 5/04–048; F01D 5/041; F01D 5/12; F01D 9/04–048; F01D 9/041; F01D 9/026; F01D 21/003; F04D 17/00–18; F04D 19/042; F04D 27/001; F04D 29/083; F04D 29/283; F04D 29/284; F04D 29/42; F04D 29/4206; F04D 29/444; F04D 29/448; F04D 29/44; F04D 29/441; F05D 2260/83
See application file for complete search history.

(56) References Cited

U.S. PATENT DOCUMENTS

| | | | | |
|---|---|---|---|---|
| 2,200,288 | A * | 5/1940 | Meininghaus | F01D 5/041 416/182 |
| 4,541,776 | A * | 9/1985 | Schon | F01D 5/03 415/109 |
| 5,071,312 | A * | 12/1991 | Kirby | F01D 1/06 29/889.22 |
| 5,594,665 | A * | 1/1997 | Walter | F04D 27/001 700/301 |
| 2014/0109576 | A1 | 4/2014 | Spadacini et al. | |
| 2014/0363268 | A1 | 12/2014 | Gaia et al. | |

FOREIGN PATENT DOCUMENTS

| | | | |
|---|---|---|---|
| WO | 2012/143799 | A1 | 10/2012 |
| WO | 2013/108099 | A2 | 7/2013 |

OTHER PUBLICATIONS

Jun. 12, 2016 Written Opinion issued in International Patent Application No. PCT/IB32015/051946.

* cited by examiner

FIG.11
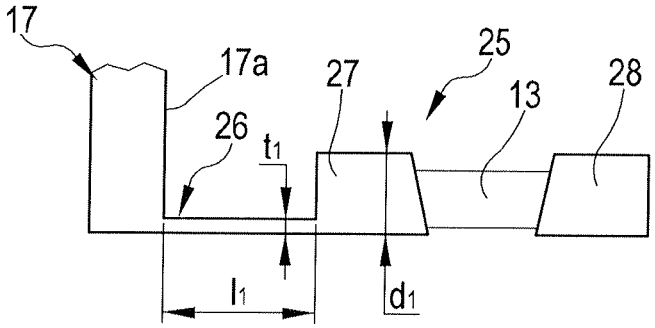
FIG.12
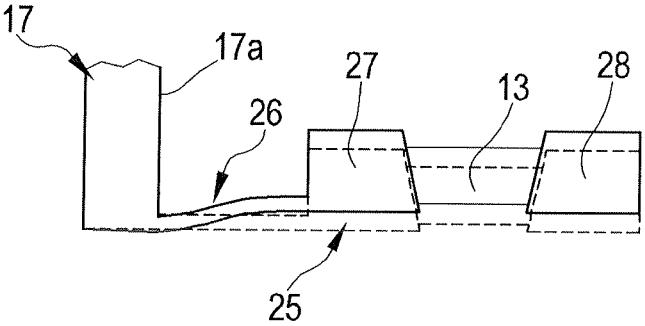
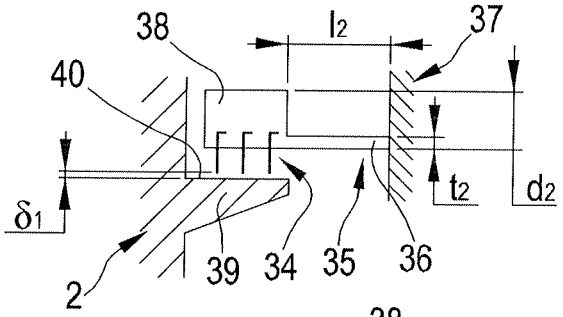
FIG.13
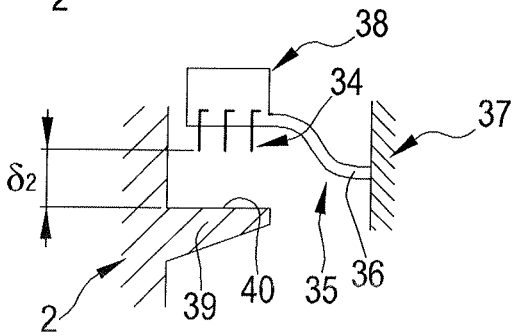
FIG.14
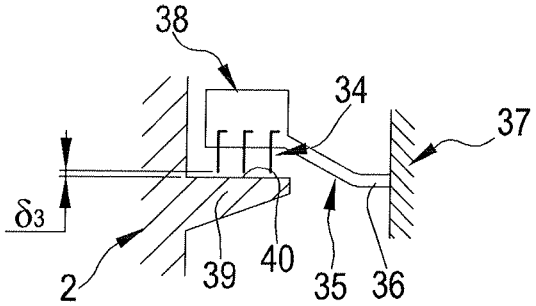
FIG.15

RADIAL TURBOMACHINE

FIELD OF THE FINDING

The subject of the present invention is a radial turbomachine. By radial turbomachine it is intended a turbomachine in which the flow of the fluid with which it exchanges energy is mainly directed in a radial sense with respect to the rotation axis of said turbomachine. The present invention is applied both to drive turbomachines (turbines) and to working turbomachines (compressors).

Preferably but not exclusively, the present invention regards expansion turbines of radial type for producing electrical and/or mechanical energy.

Preferably but not exclusively, the present invention refers to the radial expansion turbines used in apparatuses for producing energy by means of steam Rankine cycle or organic Rankine cycle (ORC).

Preferably but not exclusively, the present invention refers to the expansion turbines of centrifugal radial or "outflow" type, with this term intending that the fluid flow is radially directed from the center towards the periphery of the turbine.

BACKGROUND OF THE FINDING

The public document WO 2012/143799, on behalf of the same Applicant, illustrates an expansion turbine which comprises a fixed case having an axial inlet and a radially peripheral outlet, a single rotor disc mounted in the case and rotatable around a respective rotation axis, multiple annular series of rotor blades mounted on a front face of the rotor disc and arranged around the rotation axis, multiple annular series of stator blades mounted on the case, facing the rotor disc and radially alternated with the rotor blades.

The public document WO 2013/108099 illustrates a turbine for the expansion of an organic fluid in Rankine cycle provided with formations of rotor and stator blades that are alternated with each other in a radial direction. The supply of the steam in the turbine is obtained in a frontal direction. In a first section of the turbine, defined at high-pressure, a first expansion of the work fluid is provided in a substantially radial direction. In a second section, defined at low-pressure, a second expansion of the work fluid is provided in a substantially axial direction. The stator blades are supported by an external casing of the turbine.

Turbomachines are usually characterized by conditions of the incoming fluid (pressure and temperature) different from the conditions of the same fluid upon exiting. In the expansion turbines (drive turbomachines) like those described (WO 2012/143799 and WO 2013/108099), the inlet fluid is situated in a condition of pressure and temperature that are greater than that at the outlet. In the working turbomachines, inlet pressure and temperature are instead lower than that at the outlet.

When the turbomachine operates at normal conditions, the difference of temperature between inlet and outlet creates a temperature gradient that generates mechanical stresses in the affected components. Indeed, the portions of one component subjected to greater temperatures tend to be expanded more than the portions of the same component at lower temperatures, and this generates internal stresses since said portions are integral with each other.

The situation is even more critical in the steps of starting under cold machine conditions. In this situation, internal stresses are created between components with low thermal inertia and high thermal exchange (for example the rotor or stator blading) and components with high thermal inertia (e.g. rotor discs, diaphragms or case); such stresses can be much greater than those which are created when the machine is in normal operating conditions.

In addition, the components with high thermal inertia (usually the fixed parts) tend to be less deformed and/or over long time periods with respect to the components with low thermal inertia (usually the rotating parts) and this can cause damaging interference/seizure and in some cases even plastic deformation of parts of the machine and/or undesired variations of the clearances between said components and/or of the size of the work fluid passages. Such clearances, which are sized to the minimum (on the order of tens of millimeters) in order to prevents losses via leakage that negatively affect the efficiency of the machines (the fluid that bypasses the rotating part does not contribute to the energy exchange), therefore cannot be ensured, neither under cold nor under hot machine conditions.

As mentioned above, usually the moving parts have a lower thermal inertia than the fixed parts and it is for this reason that the step of starting/heating the machine must be executed in a sufficiently slow manner so as to ensure that interference/seizure is not created. The starting of the turbomachines of known type typically varies from a minimum of about a half hour to over three hours.

Systems are known for controlling the stresses in case of thermal gradients through the alternation of high-flexibility elements such to allow relative movements, maintaining the stresses sufficiently low.

In order to prevent the problem of interference/cancellation of the clearances, multiple solutions are known today but all can be summarized in two categories: a first, in which the fixed parts close to the rotating parts are formed by sectors and are held in position by means of a spring system and pressure balancing; a second, in which the fixed parts are made of a "softer" material and allow the rotating part to "deform" the fixed part, preventing an actual seizure. The known solutions of both categories have disadvantages: in the first case, greater clearances must be tolerated, which are due to an imperfect centering between the parts, while in the second case the repetition of the contacts leads to an early deterioration of the clearances.

SUMMARY

In such context, the Applicant has observed that the above-described turbomachines can be improved with regard to different aspects, in particular in order to prevent the generation of high mechanical stresses due to temperature gradients and to allow the quick starting thereof.

In particular, the Applicant has perceived the need to:

- considerably reduce the mechanical stresses in the fixed parts of a turbomachine which operates both in normal operating conditions and during starting, in the presence of temperature gradients that might even be high;
- considerably reduce the starting/heating times of the turbomachine;
- prevent the cancellation of the clearances between fixed parts and rotating parts.

The Applicant has found that the above-indicated objects can be attained by mounting the fixed parts that operate in strict proximity with the moving parts on a support disc free to be radially deformed, under the action of thermal gradients, at least at annular portions thereof.

In the present description and in the enclosed claims, with the adjective "axial", it is intended to define a direction directed parallel to a rotation axis "X-X" of the turbomachine. With the adjective "radial" it is intended to define a direction directed like the radii extended orthogonal from the rotation axis "X-X". With the adjective "circumferential" it is intended directions tangent to circumferences coaxial with the rotation axis "X-X".

More specifically, according to a first aspect, the present invention regards a turbomachine at least partly radial and/or radial-axial, comprising:

a fixed case;

at least one rotor disc installed in the case and having rotor blades mounted at least on a front face thereof, in which the rotor disc is rotatable in the case around a respective rotation axis; and possibly axial blades on the external perimeter of the disc;

a plurality of elements projecting from the case and terminating in proximity to the rotor disc;

at least one support plate bearing said projecting elements and installed in the case;

in which said at least one support plate is radially extended across from the rotor disc;

in which the support plate comprises:

a plurality of first circular portions concentric with the rotation axis, in which at least several of said first circular portions bear said projecting elements;

a plurality of second circular portions radially interposed between the first circular portions;

in which the second circular portions are more deformable, along radial directions, than the first circular portions in a manner so as to allow relative movements between the first circular portions when the support plate is subjected to the action of thermal gradients.

The Applicant has verified that the claimed solution allows considerably reducing the size of the internal stresses that are generated in the portions of the case where the projecting elements are constrained. This is due to the fact that the second circular portions absorb/damp the greater deformations sustained by the hotter parts with respect to those sustained by the cooler parts. For example, if the fluid flow is hotter at radially more internal parts of the turbomachine and then is progressively cooled towards the exterior, the hotter, radially more internal first portions are expanded more than the radially more external first portions. The expansions of the radially more internal first portions determine a radial compression of the more flexible second portions, which prevents the generation of excessive stress between two radially successive first portions placed at different temperatures. If the fluid flow is cooler at radially more internal parts of the turbomachine and then is progressive heated towards the exterior, the cooler radially more internal first portions tend to maintain their size while the hotter radially more external first portions are expanded. The expansions of the radially more external first portions determine a radial expansion of the more flexible second portions, which prevents the generation of excessive stresses between two radially successive first portions placed at different temperatures.

In addition, the Applicant has verified that the claimed solution allows the elements projecting from the case to be radially moved under the action of thermal gradients, following the radial deformation of the components with low thermal inertia and high thermal exchange, like the rotor blading, thus without generating dangerous interference. Such movement of the elements projecting from the case would not be allowed to a sufficient extent if these were constrained directly to a wall of the case or to a solid disc mounted in the case.

The Applicant has verified that the starting of the turbomachine can be executed in much quicker times than that of known machines, i.e. from a minimum of about five minutes up to a maximum of about a half hour.

The Applicant has also verified that such solution is structurally simple and relatively inexpensive, and allows an easy and quick assembly of the turbomachine.

In one aspect, each of the second circular portions comprises at least one flexible body having a main extension that is transverse with respect to the radial directions, in a manner so as to be adapted to be radially bent.

Preferably, each of the second circular portions comprises a plurality of flexible bodies.

Preferably, the support plate is a single piece (the flexible bodies are integrally made with the first portions), preferably obtained via removal of material and/or via molding.

Each flexible body tends to be bent when the first portions, one radially internal and one radially external, connected thereto are radially expanded in a different manner due to the temperature gradient.

In one aspect, each flexible body is an arm connecting two radially successive first circular portions.

Preferably, each arm substantially lies in a plane perpendicular to the rotation axis and is moved in said plane while it is deformed/bent. This ensures that the limited movement (due to the thermal gradients) of the projecting elements always occurs parallel to the front face of the rotor disc.

Preferably, the arms are extended along circumferential directions.

Preferably, the arms are arranged circumferentially in succession.

Preferably, the arms are curved.

Preferably, the arms are tilted with respect to a circumferential direction.

Preferably, each second portion has at least one series of arms, in which said arms are arranged circumferentially in succession.

The selection of the number, shape, arrangement and size of the arms allows adapting the radial rigidity of the second portions to the specific needs.

In one aspect, the second circular portions have through openings through the plate. The through openings render the second portions radially more deformable than the first portions. The through openings lighten the support plate and contribute to decreasing the thermal inertia thereof.

Preferably, said through openings delimit said flexible bodies/arms.

Preferably, each arm is delimited by two or more adjacent through openings.

Preferably, the through openings are slots.

Preferably, said slots are tilted with respect to a radial direction.

Preferably, said slots are curved.

Preferably, said slots are mainly elongated in a circumferential direction.

Preferably, each of said slots are extended along a circumferential direction.

Preferably, said slots are tilted with respect to a circumferential direction.

Preferably, each second portion has at least one series of slots, in which said slots are arranged circumferential in succession.

Preferably, each second portion has at least two series of slots, in which said slots of each series are arranged circumferentially in succession.

Preferably, the slots of two different series are angularly offset.

In one aspect, said at least one flexible body is a substantially cylindrical or conical wall.

Preferably, said substantially cylindrical or conical wall is coaxial with the rotation axis.

In each section, along an axial plane (plane containing the rotation axis), the deformation and bending of the substantially cylindrical or conical walls occurs in said axial plane.

Preferably, in a section along an axial plane, the support plate has at least one serpentine section defining said at least one substantially cylindrical or conical wall.

Preferably, the serpentine section is defined by cavities obtained on both faces of the support plate.

The deformation occurs as a kind of bellows movement of the serpentine.

In one aspect, the first portions are solid rings.

Preferably said solid rings have opposite faces perpendicular to the rotation axis.

In one aspect, the projecting elements comprise seal elements.

Preferably, the seal elements act against the rotor disc.

Preferably, the seal elements are operatively active on a rear face of the rotor disc. The support disc faces a rear face of the rotor disc, opposite the front face which bears the rotor blades, and bears the seal elements which act against the rotor disc.

The seal elements are installed with the purpose of decreasing the energy losses due to the leakage losses between the back of the rotor disc and the static part of the turbomachine. The seal elements minimize the fluid flow rate which, from the inlet of the turbomachine, tends to leak into the back of the rotor disc.

Preferably, the seal elements act between the rotor blades and the stator blades. In one aspect, the turbomachine comprises a single rotor disc and stator blades that are fixed with respect to the case and radially interposed between the rotor blades of the rotor disc.

In one aspect, the projecting elements comprise the stator blades radially interposed between the rotor blades of the rotor disc.

The support disc faces the front face of the rotor disc and bears the stator blades.

In one aspect, the turbomachine comprises two counter-rotating rotor discs having facing front faces and radially alternated rotor blades. In this case, the stator blades are absent.

Preferably, the counter-rotating turbomachine comprises two support discs. Each support disc faces a rear face of a respective rotor disc, opposite the front face which bears the rotor blades, and bears the seal elements which act against said rotor disc.

In one aspect, the turbomachine comprises at least one axial stage placed downstream of the rotor disc and of each of the rotor discs with respect to a direction of the flow of the work fluid. Preferably said axial stage is situated at a radially peripheral portion of the respective rotor disc (radial-axial turbomachine).

In one aspect, a portion of the support plate is integral with the case. Preferably, such portion is radially peripheral and is preferably fixed to the case, preferably by means of screws.

In one aspect, a radially peripheral surface of the support plate is always in abutment against an abutment surface of the case. Preferably, the radially peripheral surface of the support plate is cylindrical. Preferably, the abutment surface of the case is a radially internal cylindrical surface. This coupling ensures the centering of the support plate and of the projecting elements with respect to the rotation axis.

In one aspect, the support plate has a first surface bearing the projecting elements and a second surface opposite the first and fit against a wall of the case.

In one aspect, one wall of the case is provided with inspection accesses (openable and closeable). Said inspection accesses are situated at the through openings. In this manner, it is possible to inspect the interior of the turbomachine (rotor disc(s), seal elements, blades) through said through openings when the turbomachine is assembled. Preferably, said accesses and the through openings allow visually inspecting and verifying (for example by introducing a feeler gauge through the accesses and the through openings) the tolerances of the seal elements.

The present invention therefore also regards an inspection method that provides for:

- opening at least one of said inspection accesses;
- if necessary, aligning said access with at least one of the through openings, preferably by rotating the support plate;
- inspecting the interior of the turbomachine through the access and said at least one of the through openings;
- reclosing the access.

The method can also provide for verifying the tolerances of the seal elements, preferably by introducing a feeler gauge through the access and through one of the through openings.

In one aspect, the second surface delimits an interspace with the wall of the case. The interspace allows balancing the pressure (or at least reducing the pressure difference) that acts on the two faces of the plate. In other words, the geometry of the support discs, in particular of the disc that bears the stator blades, is obtained in a manner such that the radial pressure gradient does not create axial thrust. This allows obtaining the support disc with limited thickness, reducing the thermal inertia to the minimum.

Preferably, the interspace is in fluid communication with the through openings. The balancing of the pressure therefore occurs through said through openings.

Preferably, the turbomachine comprises annular gaskets (coaxial with the rotation axis) arranged between the second surface of the support plate and the wall of the case.

Preferably, each annular chamber is situated at a respective projecting element.

Pairs of successive projecting elements together delimit annular chambers. The annular gaskets isolate annular volumes of the interspace, each placed at a respective annular chamber. In this manner, each annular chamber is in pressure equilibrium with the respective annular volume.

Each annular volume and annular chamber pair defines an isobaric band. The annular gaskets serve for delimiting the annular volumes and also serve for preventing the escape of steam between bands at higher pressure and bands at lower pressure, which would reduce the efficiency of the turbomachine.

The annular gaskets ensure perfect seal also in the case of relative movement (due to the radial deformation, in particular of the second portions) between the support disc and the case.

Preferably, the annular gaskets are housed in annular seats obtained in the wall of the case.

Preferably, the annular gaskets are elastomeric and/or metal and/or made of graphite.

In one aspect, the projecting elements each comprise an annular band having a first edge joined to the support plate and a second edge directed towards the rotor disc and provided with a joint. The annular band is a kind of cylinder, preferably coaxial with the rotation axis.

In one aspect, the joint bears the stator blades.

In one aspect, the joint bears the seal elements.

In one aspect, the joint bears the stator blades and the seal elements.

In one aspect, each of the annular bands has a radial thickness less than a radial size of the respective joint.

Preferably, the radial thickness is comprised between about ½ and about 1/10 of the radial size, more preferably equal to about ¼ of the radial size.

Preferably, the ratio between an axial length of the annular band and the respective radial thickness is comprised between about 3 and about 10.

By means of such structure, the projecting elements bearing the stator blades and/or the seal elements have a low thermal inertia and are elastically unconstrained from the rotor discs.

Given that the (sealed) fixed parts in "contact" with the rotating parts (rotor discs) are constructed at low thermal inertia, during heating the fixed parts reach the normal operating temperature before the rotating parts, increasing the clearances of the seals and preventing possible sliding.

The radial yieldability of the annular bands allows the stator blades and/or the seal elements to vary their radial size without creating high internal forces, since they are not rigidly constrained to the support disc.

This structure contributes to allowing the turbomachine to work with high thermal gradients. In addition, the structure of the projecting elements described in the preceding aspects can also be present in the turbomachine in a manner independent from the structure of the support plates. Said projecting elements as described can for example be constrained to solid support plates or directly to the case.

In one aspect, the turbomachine is a compressor. At least one motor is connected to the rotor disc or to the rotor discs.

In one aspect, the turbomachine is a turbine. At least one generator is connected to the rotor disc or to the rotor discs.

In one aspect, the turbomachine is of outflow radial type. The flow of the work fluid is mainly moved from the rotation axis towards the periphery of the rotor disc or of the rotor discs.

In one aspect, the turbomachine is of inflow radial type. The flow of the work fluid is mainly moved from the periphery of the rotor disc or of the rotor discs towards the rotation axis.

Further characteristics and advantages will be clearer from the detailed description of a preferred but not exclusive embodiment of a turbomachine in accordance with the present invention.

DESCRIPTION OF THE DRAWINGS

Such description will be set forth hereinbelow with reference to the set of drawings, provided only as a non-limiting example, in which:

FIG. 11 is an enlarged stator element of the turbomachine of FIG. 1 in a first operative configuration;

FIG. 12 is the stator element of FIG. 11 in a second operative configuration; and FIGS. 13-15 illustrate an enlarged seal element belonging to the turbomachines pursuant to FIGS. 1 and 2 in respective operative configurations;

DETAILED DESCRIPTION

Figure 1:
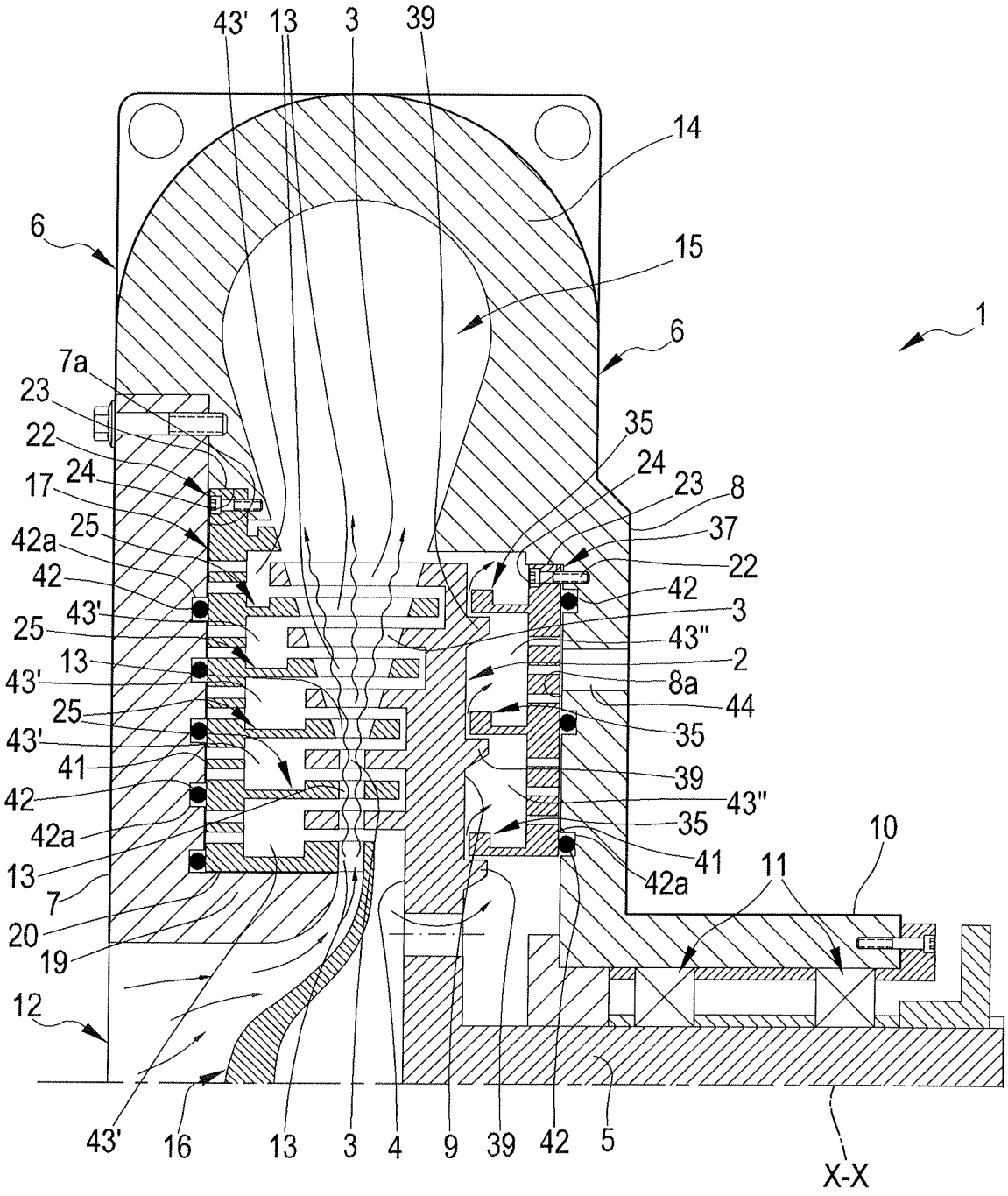
FIG. 1 illustrates a meridian section of a first embodiment of a turbomachine in accordance with the present invention.
Figure 2:
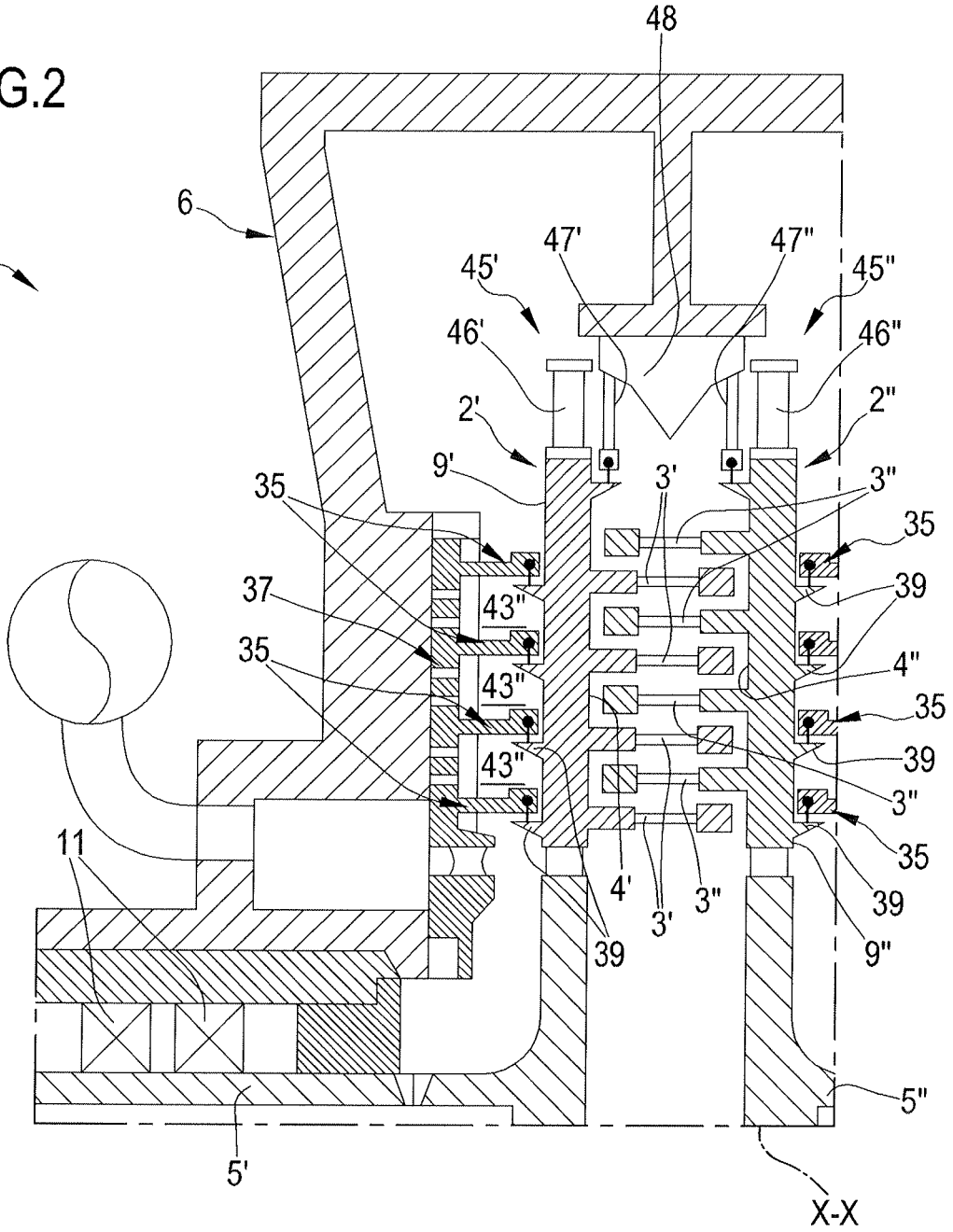
FIG. 2 illustrates a meridian section of a second embodiment of a turbomachine in accordance with the present invention.

With reference to the abovementioned figures, reference number 1 overall indicates a turbomachine in accordance with the present invention. The turbomachine 1 illustrated in FIG. 1 is an expansion turbine of outflow radial type with a single rotor disc 2. The turbomachine 1 illustrated in FIG. 2 is an expansion turbine of outflow radial type with two counter-rotating rotor discs 2.

With reference to FIG. 1, the turbine 1 comprises the rotor disc 2, provided with a plurality of rotor blades 3 arranged in series of concentric rings on a respective front face 4 of the rotor disc 2. Each series of rotor blades 3 is part of a rotor stage of the turbine 1. The rotor disc 2 is rigidly connected to a shaft 5 which is extended along a rotation axis "X-X". The shaft 5 is in turn connected to a generator (not illustrated). The rotor blades 3 are extended away from the front face 4 of the rotor disc 2 with leading edges thereof substantially parallel to the rotation axis "X-X".

Figure 16:
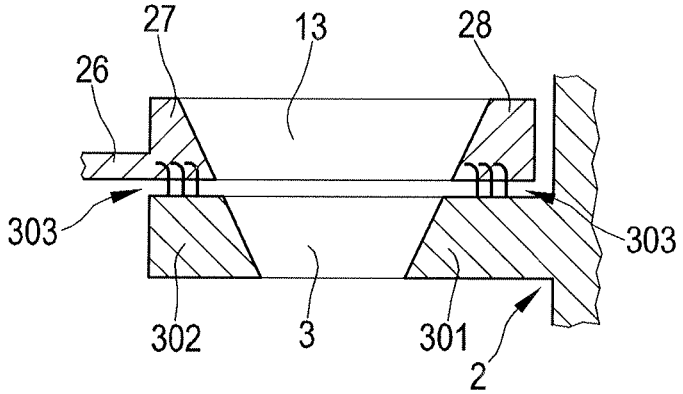
FIG. 16 illustrates a stator element and a rotor element belonging to the turbomachine of FIG. 1.

According to that illustrated in the enclosed figures, first ends of the rotor blades 3 of each series are connected and supported by a respective first rotor ring 301 integral with the rotor disc 2. Opposite ends of the same rotor blades 3 of a series are constrained to a second rotor ring 302 (FIG. 16).

The rotor disc 2 and the shaft 5 are housed in a fixed case 6 and are supported by the latter in a manner such that they can freely rotate around the rotation axis "X-X". The fixed case 6 comprises a front wall 7, placed across from the front face 4 of the rotor disc 2, and a rear wall 8, situated across from a rear face 9 of the rotor disc 2 opposite the front face 4. A sleeve 10 is integral with the rear wall 8 and rotatably houses the shaft 5 by means of the interposition of suitable bearings 11. The front wall 7 has an inlet opening 12 for a work fluid situated at the rotation axis "X-X".

The fixed case 6 also houses a plurality of stator blades 13 arranged in series of concentric rings directed towards the front face 4 of the rotor disc 2. The series of stator blades 13 are radially alternated with the series of rotor blades 3 to define a radial expansion path of the work fluid which enters through the inlet opening 12 and is expanded radially away towards the periphery of the rotor disc 2. The fixed case 6 also comprises a radially peripheral wall 14 which is extended from the front 7 and rear 8 walls and internally delimits an outlet volume 15 for the work fluid.

The turbine 1 comprises a deflector or nose 16 defined by a convex wall, placed in the inlet opening 12 and directed towards the entering flow.

The stator blades 13 are supported by a support plate 17 installed in the case 6 and constrained thereto. The support plate 17 is placed across from the front face 4 of the rotor disc 2, parallel thereto, and fit against an internal face 7*a* of the front wall 7 of the case 6.

As is visible in FIGS. 3-10, the support plate 17 is a disc provided with a central passage 18. In the central passage 18, a tubular wall 19 is housed that is part of the case 6. The tubular body 19 is extended from the front wall 7 towards the rotor disc 2 and internally delimits the inlet opening 12 of the turbine 1. A clearance is present between a radially internal edge 20 of the support plate 17 and the tubular body 19.

The support plate 17 has a plurality of through holes 21 at a radially peripheral portion thereof (FIGS. 3-10). Screws 22 housed in the through holes 21 and in threaded holes obtained in the case 6 constrain the support plate 17 to said case 6. A radially peripheral surface 23 of the support plate 17 always lies in abutment against an abutment surface 24 of the case 6. The abutment surface 24 is a cylindrical surface inside the case 6, coaxial with the rotation axis "X-X" and directed towards said rotation axis "X-X" (FIG. 1).

As is visible in FIGS. 1, 11 and 12, each series of stator blades 13 is part of a projecting element 25 that is extended away from the support plate 17. Each projecting element 25 comprises an annular band 26 (cylinder coaxial with the rotation axis "X-X") having a first edge joined to a first surface 17*a* of the support plate 17 and a second edge directed towards the rotor disc 2 and provided with a joint 27 that also has ring form.

First ends of the stator blades 13 of one series are joined to the joint 27. Second ends, opposite the first, of the stator blades 13 of the same series are all constrained to an end ring 28, it too coaxial with the rotation axis "X-X". The end rings 28 are arranged between the series of rotor blades 3 and in proximity to the front face 4 of the rotor disc 2.

Each joint 27 radially faces a respective second rotor ring 302 and each end ring 28 radially faces a respective first rotor ring 301. Seal elements 303 (e.g. labyrinth seals) are borne by each end ring 28 and by each joint 27 and act against the respective first 301 and second rotor ring 302 in order to delimit the radial expansion path of the work fluid (FIG. 16).

The annular band 26 has a radial thickness "t1" less than a radial size "d1" of the respective joint 27. For example, the radial thickness "t1" is equal to about ⅙ of the radial size "r1". For example, the ratio between an axial length "l1" of the annular band 26 and the respective radial thickness "t1" is comprised between about 3 and about 10.

The support plate 17 is formed by a plurality of first circular portions 29 concentric with the rotation axis "X-X" and by a plurality of second circular portions 30 radially interposed between the first circular portions 29.

The projecting elements 25 which bear the stator blades 13 are connected to the and supported by the first circular portions 29.

The second circular portions 30 are more deformable, along radial directions, than the first circular portions 29 in a manner so as to allow relative movements between the first circular portions 29 (and between different series of stator blades 13) when the support plate 17 is subjected to the action of thermal gradients.

Figure 3:
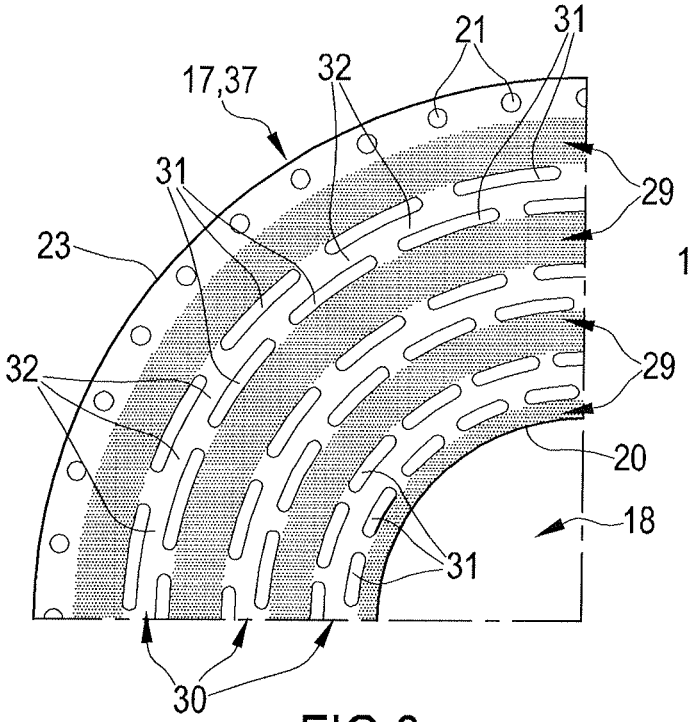
FIG. 3 illustrates a rear view of a portion of a support plate belonging to the turbomachines pursuant to FIGS. 1 and 2.
Figure 4:
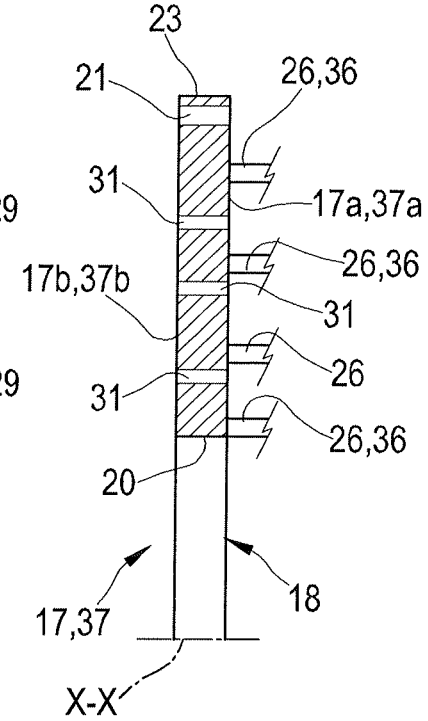
FIG. 4 is a meridian half-section of the support plate of FIG. 3.
Figure 5:
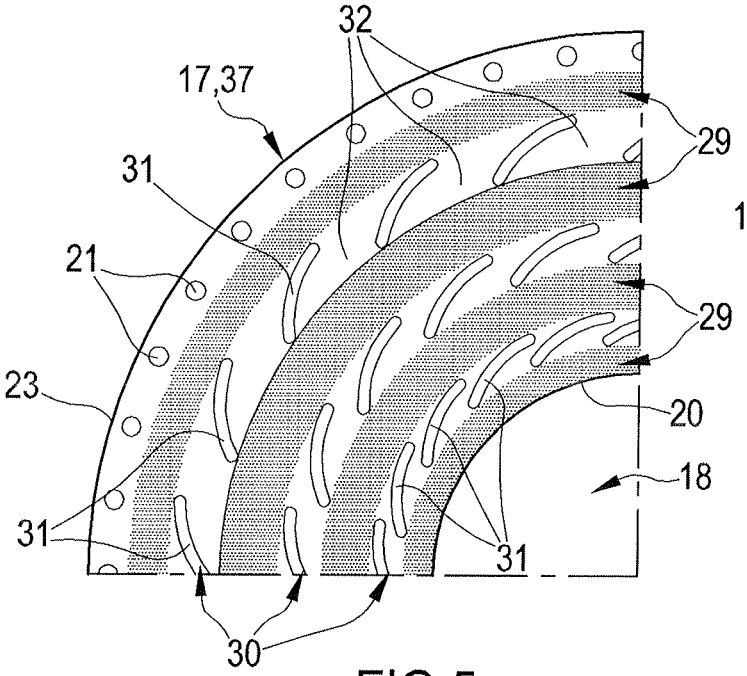
FIG. 5 illustrates a variant of the support plate of FIG. 3.
Figure 6:
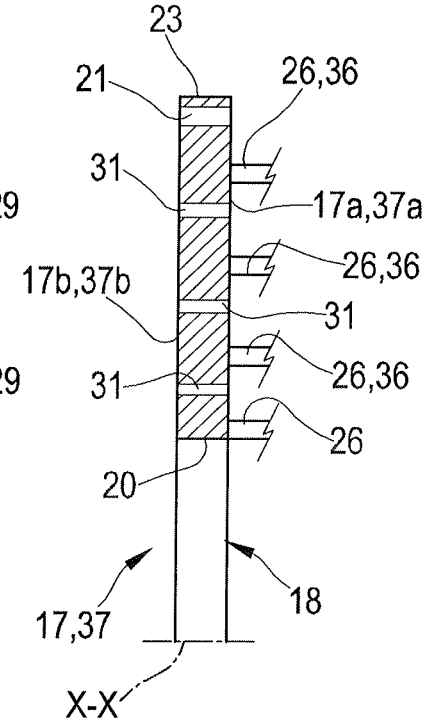
FIG. 6 is a meridian half-section of the support plate of FIG. 5.

According to the embodiment of FIGS. 3 and 4 and the variant of FIGS. 5 and 6, the support plate 17 has a constant thickness (as is visible in FIG. 1). The first portions 29 are defined by solid rings with opposite faces perpendicular to the rotation axis "X-X". The second portions 30 have a plurality of through openings 31 arranged along the circumferential extension of each second portion 30. The illustrated through openings 31 are slots with elongated form.

According to the embodiment of FIGS. 3 and 4, each of the second portions 30 has a radially more internal first series of slots 31 and a radially more external second series of slots 31. Each of the two series comprises a plurality of said slots 31 arranged circumferentially in succession and each of the slots 31 is extended along the circumferential direction. In addition, the slots 31 of the two different series are angularly offset, i.e. mutually rotated around the rotation axis "X-X", in a manner such that any radius that extends from said rotation axis "X-X" intersects at least one of said slots 31. The two series of slots 31 together delimit flexible bodies or arms 32 that are extended along circumferential directions and are arranged circumferentially in succession. The arms 32 are perpendicular to the radial directions.

According to the variant of FIGS. 5 and 6, each of the second portions 30 has a single series of slots 31. The series comprises a plurality of said slots 31 arranged circumferentially in succession. Each of the slots 31 is curved and tilted with respect to a circumferential direction. Adjacent pairs of slots 31 together delimit an arm or flexible body 32. Each arm 32 is curved and connects two of the radially successive first circular portions 29.

Figure 7:
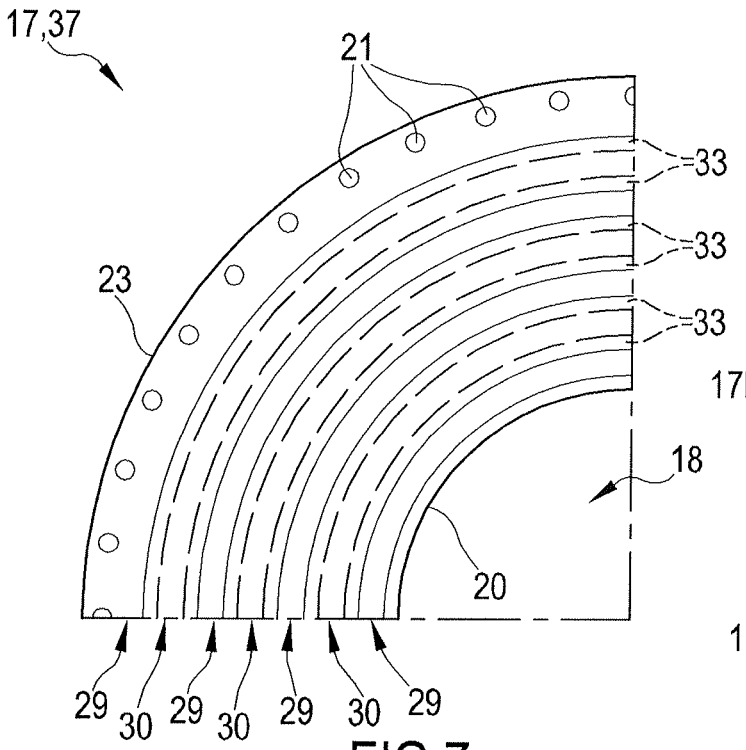
FIG. 7 illustrates a further variant of the support plate of FIG. 3.
Figure 8:
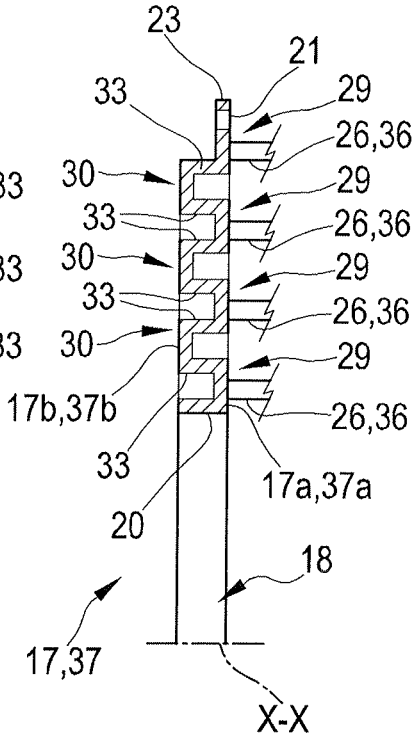
FIG. 8 is a meridian half-section of the support plate of FIG. 7.
Figure 9:
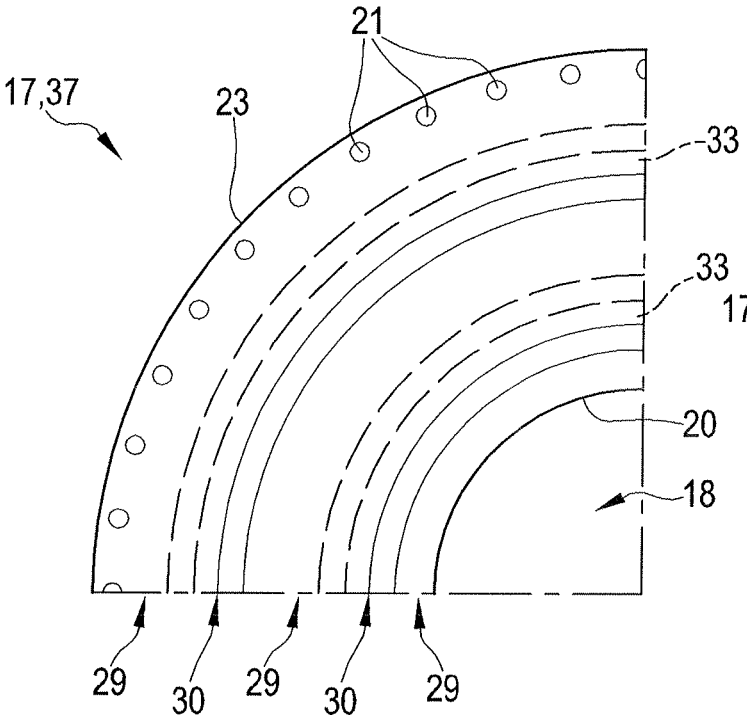
FIG. 9 illustrates a further variant of the support plate of FIG. 3.
Figure 10:
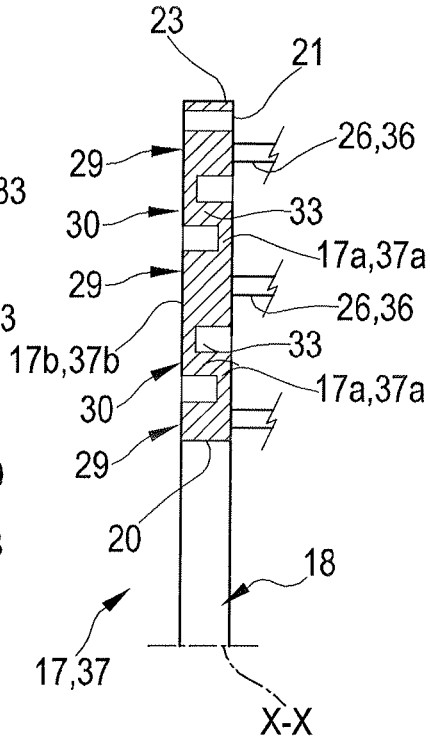
FIG. 10 is a meridian half-section of the support plate of FIG. 9.

According to the embodiment of FIGS. 7 and 8 and the variant of FIGS. 9 and 10, each of the (radially more deformable) second circular portions 30 comprises at least one flexible body defined by a substantially cylindrical wall 33 coaxial with the rotation axis "X-X".

According to the embodiment of FIGS. 7 and 8, in a meridian section, the support plate 17 has as a serpentine shape defined by radial sections and axial sections. The axial sections constitute the substantially cylindrical walls 33. Some of the radial sections constitute the first portions 29 that bear the annular bands 26. In other words, each of the second portions 30 comprises two axial sections 33 connected by a radial section. Each of the first portions 29 is defined by a radial section. From a different standpoint, the support plate 17 has annular cavities on both faces which are radially alternated in a manner so as to define the aforesaid serpentine shape.

According to the embodiment of FIGS. 9 and 10, in a meridian section, the second portions 30 each comprise an axial section constituting the substantially cylindrical wall 33 and two radial sections extended from opposite ends of the axial section 33. The first portions 29 each have a thickness (measured in the axial direction) equal to the axial length of the axial sections 33. From a different standpoint, each of the second portions 30 is defined by two radially successive annular cavities, each formed on one of the faces of the support plate 17.

The support plate 17, in accordance with the above-described embodiments, is a single piece preferably obtained via removal of material and/or via molding.

The turbine 1 of FIG. 1 also comprises seal elements 34 (e.g. labyrinth seals) acting at the rear face 9 of the rotor disc 2. The seal elements 34 are borne by projecting elements 35 geometrically similar to the projecting elements 25 that bear the stator blades 13.

The turbine 1 comprises a plurality of projecting elements 35 coaxial with the rotation axis, arranged radially in succession at at least several of the stages situated on the opposite side of the rotor disc 2.

As is more visible in FIGS. 13-15, each projecting element 35 comprises an annular band 36 (cylinder coaxial with the rotation axis "X-X") having a first edge joined to a first surface 37*a* of a support plate 37 and a second edge directed towards the rotor disc 2 and provided with a seal-carrier joint 38 that also has ring shape.

The annular band 36 has a radial thickness "t2" less than a radial size "d2" of the respective seal-carrier joint 38. For example, the radial thickness "t2" is equal to about ⅙ of the radial size "r2". For example, the ratio between an axial length "12" of the annular band 36 and the respective radial thickness "t2" is comprised between about 3 and about 10.

In the illustrated embodiment, the seal elements 34 are flexible appendages which are radially extended towards the rotation axis "X-X" from the seal-carrier joint 38.

On the second face 9 or rear face of the rotor disc 2, the same number of annular reliefs 39 and projecting elements 35 are present. Each of the annular reliefs 39 has a radially external surface 40 facing towards the seal elements 34 of the respective seal-carrier joint 38.

The support plate 37 that bears the seal elements 34 is structurally identical (apart from the specific sizing) to the support plate 17 that bears the stator blades 13. Therefore, for the detailed description of the support plate 37 that bears the seal elements 34, reference is made to the preceding description relative to the support plate 17 for the stator blades 13 and to the relative FIGS. 3-10. The support plate 37 is placed across from the rear face 9 of the rotor disc 2, parallel thereto, and fit against an internal face 8*a* of the rear wall 8 of the case 6.

Also the support plate 37 for the seal elements 34 is constrained to the case 6 by means of screws 22 passing into the through holes 21. A radially peripheral surface 23 of the support plate 37 always lies in abutment against an abutment surface 24 of the case 6. The abutment surface 24 is a cylindrical surface inside the case 6, coaxial with the rotation axis "X-X" and directed towards said rotation axis "X-X" (FIG. 1).

For both support plates 17, 37, a first surface 17*a*, 37*a* is connected to the annular bands 26, 36 of the projecting elements 25, 35 and a second surface 17*b*, 37*b*, opposite the first, delimits an interspace 41 with the internal face 7*a*, 8*a* of the respective wall 7, 8 of the case 6. Annular gaskets 42 (coaxial with the rotation axis "X-X") are arranged between the second surface 17*b*, 37*b* of the support plate 17, 37 and the wall 7, 8 of the case 6, each at a respective projecting element 25, 35. The annular gaskets 42 are for example elastomeric, made of metal or graphite. The annular gaskets 42 are housed in annular seats 42*a* obtained on the internal face 7*a*, 8*a* of the respective wall 7, 8 of the case 6.

Pairs of successive projecting elements 25, 35 together delimit annular chambers 43', 43". First annular chambers 43' are delimited between two radially successive projecting elements 25 that bear the stator blades 13, the respective support plate 17 and end of the rotor blades 3. Second annular chambers 43" are delimited between two projecting elements 35 that bear the seal elements 34, the respective support plate 37 and the second face 9 of the rotor disc 2.

The annular gaskets 42 isolate annular volumes of the interspace 41, each placed at a respective annular chamber 43', 43". Each annular volume of the interspace 41 is in fluid communication with the respective annular chamber 43', 43" through the through openings 31 of the respective support plate 17, 37 of FIGS. 3-6 or through openings suitably obtained (not illustrated) in the support plates 17, 37 of FIGS. 7-10.

In the front wall 7 and/or in the rear wall 8 of the case 6, inspection accesses 44 are obtained (one is schematically illustrated in FIG. 1), i.e. holes/openings with suitable seal closure elements that can be removed and repositioned, situated at the through openings 31.

The counter-rotating turbine 1 of FIG. 2 comprises a fixed case 6 that houses at its interior a first rotor disc 2' and a second rotor disc 2". The rotor discs 2', 2" can freely rotate, each in a manner independent from the other, in the case 6 around a common rotation axis "X-X". For such purpose, the first disc 2' is integral with a respective first rotation shaft 5' mounted in the case 6 by means of bearings 11. The second disc 2" is integral with a respective second rotation shaft 5" mounted in the case 6 by means of respective bearings 11, not illustrated.

The first rotor disc 2' is provided with a plurality of rotor blades 3' arranged in series of concentric rings on a respective front face 4' of the first rotor disc 2'. The second rotor disc 2" is provided with a plurality of rotor blades 3" arranged in series of concentric rings on a respective front face 4" of the second rotor disc 2".

The front face 4' of the first rotor disc 2' is placed across from the front face 4" of the second rotor disc 2" and the blades 3' of the first disc 2' are radially alternated with the blades 3" of the second disc 2". The blades 3' of the first rotor disc 2' terminate in proximity to the front face 4" of the second rotor disc 2" and the blades 3" of the second rotor disc 2" terminate in proximity to the front face 4' of the first rotor disc 2'.

The turbine 1 of FIG. 2 also comprises seal elements 34 acting at the rear faces 9', 9" of the rotor discs 2', 2". The seal elements 34 are borne by projecting elements 35 mounted on support plates 37. On the second face 9', 9" of each of the rotor discs 2', 2", the same number of annular reliefs 39 and projecting elements 35 are present. Each of the annular reliefs 39 has a radially external surface 40 facing towards the seal elements 34 of the respective seal-carrier joint 38.

The support plates 37, the projecting elements 35 and the seal elements 34 are entirely similar to those described for the turbine 1 of FIG. 1 and illustrated in FIGS. 3-10 and 13-15 (the same reference numbers have also been used) and therefore will not be newly described herein.

The counter-rotating turbine 1 of FIG. 2 also comprises an axial stage 45', 45" for each of said first rotor disc 2' and second rotor disc 2" The axial stages are placed at radially peripheral portions of each rotor disc 2', 2". More in detail, a series of rotor blades 46', 46" of the respective axial stage 45', 45" are radially extended from the peripheral edge of the respective rotor disc 2', 2". A series of stator blades 47', 47" of the respective axial stage 45', 45" are radially extended from a portion 48 of the case 6 towards the rotation axis "X-X". The rotor blades 46', 46" are placed across from the stator blades 47', 47" along an axial direction.

An axial stage, for example of the above-described type, can also be provided in an embodiment variant (not illustrated) of the turbomachine of FIG. 1.

During use and with reference to the turbine 1 of FIG. 1, the work fluid enters into the turbomachine through the inlet opening 12; being expanded, it transmits work on the rotor blades 3 and finally exits from the turbine 1 crossing through the outlet volume 15. The mechanical work is transmitted by the rotor disc 2 to the generator (not illustrated) through the shaft 5.

Given the characteristic structure of the radial machine, the temperature profile varies from the inlet towards the outlet, i.e. in radial direction. This variation of the temperature creates an axial temperature gradient on the support discs 17, 37 and on the projecting elements 25, 35.

The radially more internal first circular portion 29 is heated before the successive first circular portion 29; it tends to expand more and the expansion is absorbed by the radial compression of the second circular portion 30 that lies between the two. This phenomenon, as the disc 17, 37 is progressively heated, is verified throughout the support disc 17, 37 and prevents the generation of excessive internal stresses.

FIGS. 11 and 12 show, by way of example, the geometric variation of the projecting elements 24 that bear the stator blades 13. The support disc 17, even if provided with the second circular portions 30 that are radially more deformable (than the first 29), tends to be radially expanded less than the joint 27 and the end ring 28 so that under hot (normal operating) conditions, the annular band 26 is deformed and allows the joint 27 and the end ring 28 said expansion (FIG. 11: cold configuration; FIG. 12: configuration at operating conditions).

FIGS. 13-15 show, by way of example, what happens at the seal elements 34. Starting from a phase (FIG. 13) with the machine off and cold up to an operating condition phase (FIG. 15) passing through a starting phase (FIG. 14). First, (FIG. 14) the seal-carrier joint 38 is radially expanded, due to the flexibility of the annular band 36, then the rotor disc 2 is expanded and also the support disc 37 is slightly expanded. During all these phases, the invention ensures a minimum clearance (δ1, δ2, δ3) between the seal elements 34 and the annular reliefs 39. Such clearance, as a function of the starting speed, can only increase with respect to the starting condition, ensuring that there is never interference between rotating and fixed parts.

The invention claimed is:

1. A radial turbomachine, comprising:

a fixed case (6);

at least one rotor disc (2, 2', 2") installed in the case (6) and having rotor blades (3, 3', 3") mounted at least on a front face (4, 4', 4") thereof, in which the rotor disc (2, 2', 2") is rotatable in the case (6) around a respective rotation axis (X-X);

a plurality of elements (25, 35) projecting from the case (6) and terminating in proximity to the rotor disc (2, 2', 2"); and at least one support plate (17, 37) installed in the case (6); wherein said support plate (17, 37) bears said elements (25, 35) projecting from the case (6), wherein said at least one support plate (17, 37) is radially extended across from the rotor disc (2, 2', 2"), wherein the support plate (17, 37) comprises:

a plurality of first circular portions (29) concentric with the rotation axis (X-X), wherein said first circular portions (29) bear said projecting elements (25, 35); and a plurality of second circular portions (30) radially interposed between the first circular portions (29), wherein the second circular portions (30) are configured to deform to a greater extent, along radial directions, than the first circular portions (29) in a manner so as to allow relative movements between the first circular portions (29) when the support plate (17, 37) is subjected to action of thermal gradients, wherein each of the second circular portions (30) comprises a plurality of flexible bodies (32, 33), having a main extension that is transverse with respect to the radial directions, and wherein the second circular portions (30) have through openings (31) through the support plate (17, 37) and said through openings (31) delimit said flexible bodies (32).

2. The turbomachine according to claim 1, wherein each flexible body (32, 33) is an arm connecting two radially successive first circular portions (29).

3. The turbomachine according to claim 2, wherein the arms are extended along circumferential directions.

4. The turbomachine according to claim 2, wherein the arms are tilted with respect to a circumferential direction.

5. The turbomachine according to claim 2, wherein each arm is delimited by two or more adjacent through openings (31).

6. The turbomachine according to claim 1, wherein the through openings (31) are slots.

7. The turbomachine according to claim 6, wherein said slots (31) are elongated in a circumferential direction.

8. The turbomachine according to claim 1, wherein the first circular portions (29) are solid rings having opposite faces perpendicular to the rotation axis (X-X).

9. The turbomachine according to claim 1, wherein the projecting elements (25, 35) comprise seal elements (34) acting against the rotor disc (2, 2', 2") and operatively active on a rear face (9, 9', 9") of the rotor disc (2, 2', 2").

10. The turbomachine according to claim 9, wherein the projecting elements (35) each comprise an annular band (36) having a first edge joined to the support plate (37) and a second edge directed towards the rotor disc (2, 2', 2") and provided with a joint (38) bearing the seal elements (34).

11. The turbomachine according to claim 10, wherein each of the annular bands (26, 36) has a radial thickness (t1, t2) less than a radial size (d1, d2) of the joint (27, 38).

12. The turbomachine according to claim 11, wherein the radial thickness (t1, t2) is between ¼ and about 1/10 of the radial size (d1, d2).

13. The turbomachine according to claim 1, wherein the projecting elements (25, 35) comprise stator blades (13) radially interposed between the rotor blades (3) of the rotor disc (2).

14. The turbomachine according to claim 13, wherein the projecting elements (25) each comprise an annular band (26) having a first edge joined to the support plate (17) and a second edge directed towards the rotor disc (2) and provided with a joint (27) bearing stator blades (13).

15. The turbomachine according to claim 14, wherein each of the annular bands (26, 36) has a radial thickness (t1, t2) less than a radial size (d1, d2) of the joint (27, 38).

16. The turbomachine according to claim 15, wherein the radial thickness (t1, t2) is between ¼ and 1/10 of the radial size (d1, d2).

17. The turbomachine according to claim 1, wherein a portion of the support plate (17, 37) is fixed to the case (6).

18. The turbomachine according to claim 1, wherein a radially peripheral surface (23) of the support plate (17, 37) is in abutment against an abutment surface (24) of the case (6) in order to ensure the centering of the projecting elements (25, 35) with respect to the rotation axis (X-X).

19. The turbomachine according to claim 18, wherein the abutment surface (24) of the case (6) is a radially internal cylindrical surface.

20. The turbomachine according to claim 1, wherein the support plate (17, 37) has a first surface (17*a*, 37*a*) bearing the projecting elements (25, 35) and a second surface (17*b*, 37*b*) opposite the first surface (17*a*, 37*a*) and fit against a wall (7*a*, 8*a*) of the case (6).

21. The turbomachine according to claim 20, wherein said wall of the case (7*a*, 8*a*) is provided with at least one inspection access (44) situated at the through openings (31) through the support plate (17, 37) in order to allow inspecting the interior of the turbomachine (1) through said through openings (31).

22. The turbomachine according to claim 1, wherein the support plate (17, 37) has a first surface (17*a*, 37*a*) bearing the projecting elements (25, 35) and a second surface (17*b*, 37*b*) opposite the first and fit against a wall (7*a*, 8*a*) of the case (6), wherein said second surface (17*b*, 37*b*) delimits an interspace (41) with the wall (7*a*, 8*a*) of the case (6).

* * * * *